US006779972B2

(12) United States Patent
Farrell et al.

(10) Patent No.: US 6,779,972 B2
(45) Date of Patent: Aug. 24, 2004

(54) FLOWPATH SEALING AND STREAMLINING CONFIGURATION FOR A TURBINE

(75) Inventors: Alison Carol Farrell, Niskayuna, NY (US); Douglas Carl Hofer, Clifton Park, NY (US); Norman Douglas Lathrop, Ballston Lake, NY (US); Raymond Kenneth Overbaugh, Jr., Berne, NY (US); William Thomas Parry, Saratoga Springs, NY (US); Kenneth James Robertson, Broadalbin, NY (US)

(73) Assignee: General Electric Company, Schenectady, NY (US)

( * ) Notice: Subject to any disclaimer, the term of this patent is extended or adjusted under 35 U.S.C. 154(b) by 65 days.

(21) Appl. No.: 10/284,358

(22) Filed: Oct. 31, 2002

(65) Prior Publication Data

US 2004/0086379 A1 May 6, 2004

(51) Int. Cl.[7] ..... F01D 11/02
(52) U.S. Cl. ..... 415/174.5; 416/222
(58) Field of Search ..... 415/173.7, 174.5, 415/115, 116; 416/222, 215, 216, 193 A

(56) References Cited

U.S. PATENT DOCUMENTS 2,857,132 A * 10/1958 McDowall ..... 416/92
4,457,668 A * 7/1984 Hallinger ..... 416/95
6,036,437 A * 3/2000 Wolfe et al. ..... 415/173.3
6,131,910 A * 10/2000 Bagepalli et al. ..... 277/355
6,168,377 B1 * 1/2001 Wolfe et al. ..... 415/174.2
6,431,827 B1 * 8/2002 Wolfe et al. ..... 415/173.3
6,589,012 B2 * 7/2003 Burnett et al. ..... 415/174.2

FOREIGN PATENT DOCUMENTS

JP 59208104 A * 11/1984 ..... F01D/5/32

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

The root region of a flowpath through a turbine includes a sealing configuration for minimizing leakage flow and secondary aerodynamic losses. Entrance and exit root radial seals are provided between upstream and downstream nozzles at locations radially inwardly of the root region of the flowpath to minimize radial leakage flow. To minimize intrusion flow into the flowpath from rotor pumping action and consequent aerodynamic losses, an exit flow guide on each bucket turns the exiting radial flow in a predominantly axial direction. Additionally, the upstream bucket root radius and nozzle root radius are faired or tapered to minimize the possibility of a protuberance projecting into the flowpath at steady state operation. An additional entrance root axial fin is provided on the buckets to reduce the flow coefficient and afford further reduction in leakage flow.

8 Claims, 2 Drawing Sheets

FLOWPATH SEALING AND STREAMLINING CONFIGURATION FOR A TURBINE

BACKGROUND OF THE INVENTION

The present invention relates to a flowpath configuration for a turbine facilitating streamline flow characteristics along the flowpath and sealing and particularly relates to a flowpath configuration for a steam turbine for minimizing leakage flow and secondary aerodynamic losses at the steam path root regions.

The flowpath through a turbine along the root radius is defined in part by the inner bands or rings of the nozzles and flow surfaces along the platforms at the roots of the buckets on the rotor. Any fluid flow leakage exiting the flowpath along the root radii bypasses the buckets and directly decreases the power output of the turbine stage. A typical nozzle and bucket design, for example, for a low pressure section of a steam turbine, includes a nozzle root diameter equal to the bucket root diameter, resulting in a significant probability of an upstream facing step at a steady state flow condition which disturbs the streamline characteristics of the fluid flow in the flowpath. Large wheel spaces also increase the rotor pumping effect of leakage flows and therefore increase radial intrusion flow which causes further aerodynamic losses. More particular, radial reentry flows caused by rotor pumping effects cause fluid flow separation along the flowpath with consequent aerodynamic efficiency losses. Accordingly, there has developed a need for a root radius flowpath configuration for a turbine which will ensure that streamlining of fluid flow in the flowpath is substantially independent of flowpath degradation by minimizing leakage flow and secondary aerodynamic losses in the fluid flowpath root region.

BRIEF DESCRIPTION OF THE INVENTION

In accordance with a preferred embodiment of the present invention, there is provided a flowpath root region which substantially minimizes upset of the fluid flow in the flowpath, minimizes leakage flow and facilitates streamline flow in the flowpath. Particularly, the root region of the flowpath includes the inner band of the nozzles and the surfaces of the platforms at the roots of the buckets. The bucket platforms form part of the bucket dovetails. Each bucket dovetail includes entrance and exit root side radial seals radially inwardly of the platforms and radially underlying exit and entrance labyrinth seals on adjacent nozzles. These seals reduce leakage flows into and out of the wheel spaces between the rotor wheel and adjacent nozzles. The wheel spaces between the dovetails and rotor wheel, on the one hand, and the nozzles on the other hand, are reduced to reduce the rotor pumping action and, hence, intrusion flow returning to the flowpath.

It will be appreciated that combined leakage flows pass between the nozzles and the buckets for entry into the upstream wheel space where the flow combines with leakage flow through an upstream packing ring for passage through a wheel hole to a downstream wheel space. The leakage flow into the downstream wheel space in part exits into the fluid flowpath past the exit root radial seal. There is provided adjacent the exit root radial seal an exit flow guide which minimizes flowpath disturbance by decreasing the radial component of the intrusion flow, i.e., the return leakage flow into the flowpath has a substantially large or predominant axial flow component, as compared with its radial flow component. The predominant axial flow component minimizes upset of the fluid flow in the flowpath. The exit flow guide becomes increasingly important as packing seal capability decreases with time, causing greater intrusion flows returning to the fluid flowpath. The exit flow guide also serves to minimize the axial distance between the bucket and the next stage nozzle, facilitating flow streamlining in the flowpath.

Each bucket also has an entrance root radius extending axially upstream and radially inwardly to minimize or eliminate any flowpath entrance projection in the path of the fluid exiting the trailing edge of the inner band of the upstream nozzle. This minimizes the possibility of an axially forwardly facing step at steady state condition where such step could interrupt the fluid flow in the flowpath. Thus, the bucket entrance root diameter on its upstream side is less than the nozzle exit root diameter on the downstream side. Similarly, the downstream nozzle entrance root radius lies radially inwardly of the trailing edge of the upstream platform surface. This likewise avoids upsets in the fluid flowing along the flowpath and affords a robustness between the bucket exit and nozzle entrance.

Additionally, on the leading edge of the bucket platform, there is provided an entrance root axial sealing fin which affords an additional reduction in flow coefficient, further reducing leakage flow. The axial sealing fin also reduces the axial distance between the nozzle and bucket to improve fluid path streamline characteristics in the flowpath.

In a preferred embodiment according to the present invention, there is provided a turbine comprising a rotor having wheels at axially spaced locations along the rotor and mounting a plurality of circumferentially spaced buckets, the rotor being rotatable about an axis, axially spaced circumferential arrays of nozzles having circumferentially spaced airfoils and inner and outer bands at opposite ends thereof, the axially spaced buckets and the arrays of nozzles forming at least a pair of axially spaced stages of the turbine, the buckets having dovetails for securing the buckets to the rotor wheels and platforms along radially inner ends of the buckets, the platforms, the airfoils, the inner and outer bands and the buckets in part defining a flowpath for fluid flow through the turbine, the bucket dovetails on one of the wheels mounting projections extending generally axially toward one of the arrays of nozzles along locations radially inwardly of the platforms, the nozzles of the one array thereof carrying labyrinth teeth forming with the projections a seal to reduce leakage flow from the flowpath into a wheel space between the one wheel and the one array of nozzles.

In a further preferred embodiment according to the present invention, there is provided a flowpath streamlining configuration for root regions of a turbine flowpath comprising a rotor rotatable about an axis and mounting a plurality of circumferentially spaced buckets, an axially spaced circumferential array of nozzles having circumferentially spaced airfoils with inner and outer bands at opposite ends thereof spaced axially downstream of the buckets, the buckets having dovetails for securing the buckets and rotor to one another and platforms along radially inner ends thereof, the platforms and the inner bands in part defining the root region of the flowpath for fluid flow through the turbine, the bucket dovetails including exit flow guides along a downstream side of the dovetails for directing leakage fluid flow from a wheel space between the dovetails and the nozzles into the flowpath in a predominantly downstream axial direction.

In a further preferred embodiment according to the present invention, there is provided a turbine comprising a rotor rotatable about an axis and mounting a plurality of circumferentially spaced buckets having platforms along radially inner ends thereof, an axially spaced circumferential array of nozzles having circumferentially spaced airfoils with inner and outer bands at opposite ends thereof, the platforms, the buckets, the inner and outer bands and the airfoils in part defining a flowpath for fluid flow through the turbine, the array of nozzles being axially spaced upstream of the buckets and leading edges of the bucket platforms lying radially inwardly of trailing edges of the upstream array of nozzles.

DETAILED DESCRIPTION OF THE INVENTION

Figure 1:
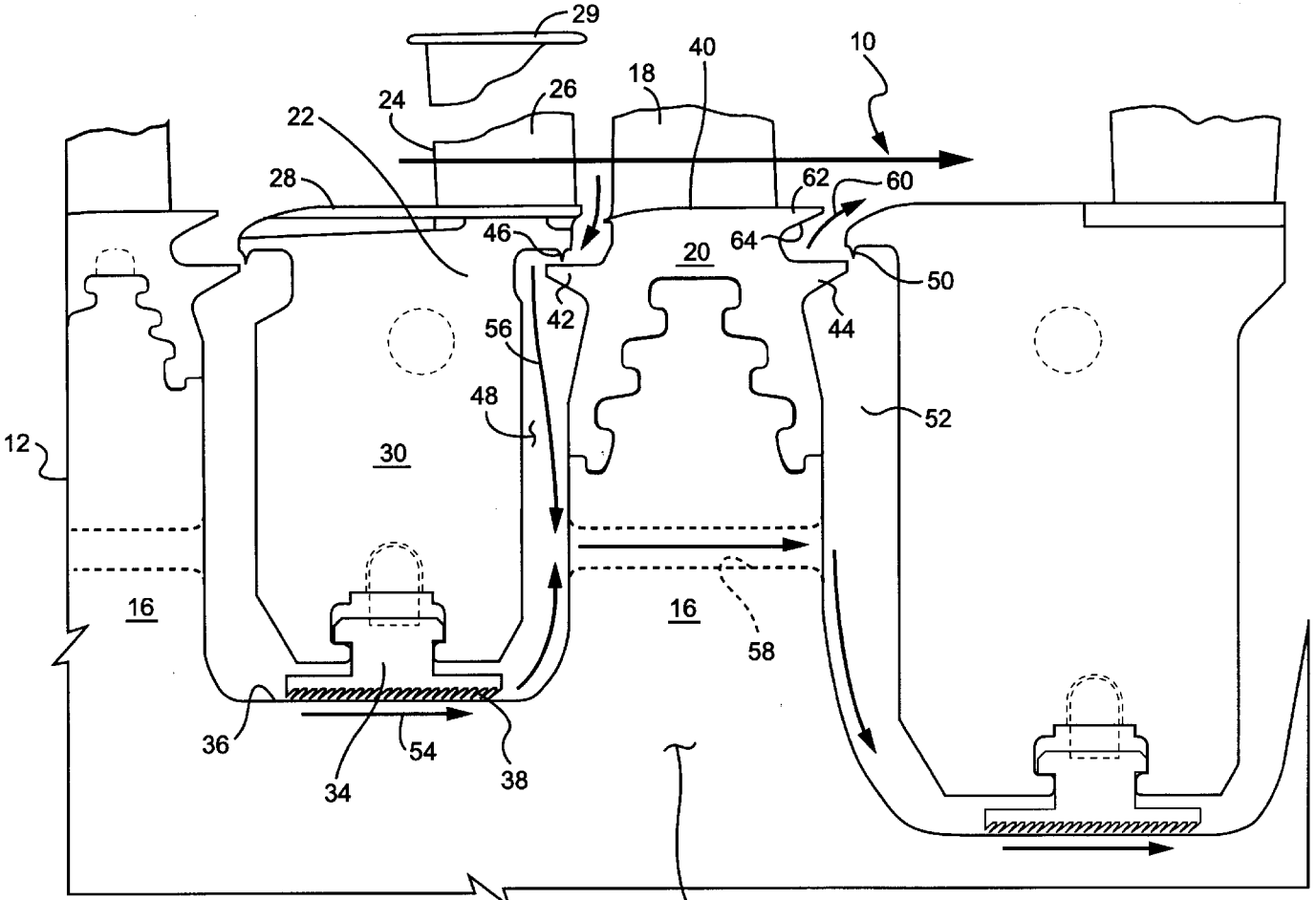
FIG. 1 is a fragmentary side elevational view of a portion of a turbine illustrating root regions of a flowpath through the turbine with improved sealing configurations, according to a preferred embodiment of the present invention.

Referring now to the drawing figures, particularly to FIG. 1, there is illustrated an inner or root region of a flowpath, indicated by the arrow and generally designated 10 of a turbine 12. Energetic fluid, e.g., steam, flows along flowpath 10 and in the direction of the arrow. Turbine 12 includes a rotor 14 rotatable about a horizontal axis and a plurality of axially spaced rotor wheels 16, each carrying a plurality of circumferentially spaced buckets 18 mounted on dovetails 20 at the base of the buckets for forming dovetail connections with the wheels 16. Also illustrated in FIG. 1 is a stationary component 22 of the turbine, including axially spaced arrays of nozzles 24. Each array of nozzles 24 has circumferentially spaced stationary airfoils 26 mounted between inner bands or rings 28 and outer bands or rings 29. The nozzles also carry inner webs 30 located between the rotor wheels and dovetails 20 of axially adjacent buckets 18. Consequently, each nozzle 24 and a downstream array of buckets 18 form a nozzle stage, there being a plurality of nozzle stages within the turbine section of the turbine. As is conventional, packing rings 34 are provided between the stationary component 24, e.g., the inner webs 30, and the rotor surface 36 between the rotor wheels 16 for sealing leakage flowpaths between the stationary and rotary components. The packing ring segments 34 typically carry a plurality of labyrinth seal teeth 38 which degrade over time.

In FIG. 1, it will be appreciated that the root region of the flowpath 10 includes the inner bands 28, and platforms 40 at the base of each bucket 18. Gaps necessarily appear between trailing edge exit portions of the nozzles and leading edge entrance portions of the buckets, as well as between trailing edge portions of the buckets and leading edge portions of the nozzles. These gaps between the rotating and stationary components present leakage flowpaths for the fluid flowing along flowpath 10 and aerodynamic losses in the root region of flowpath 10.

Figure 2:
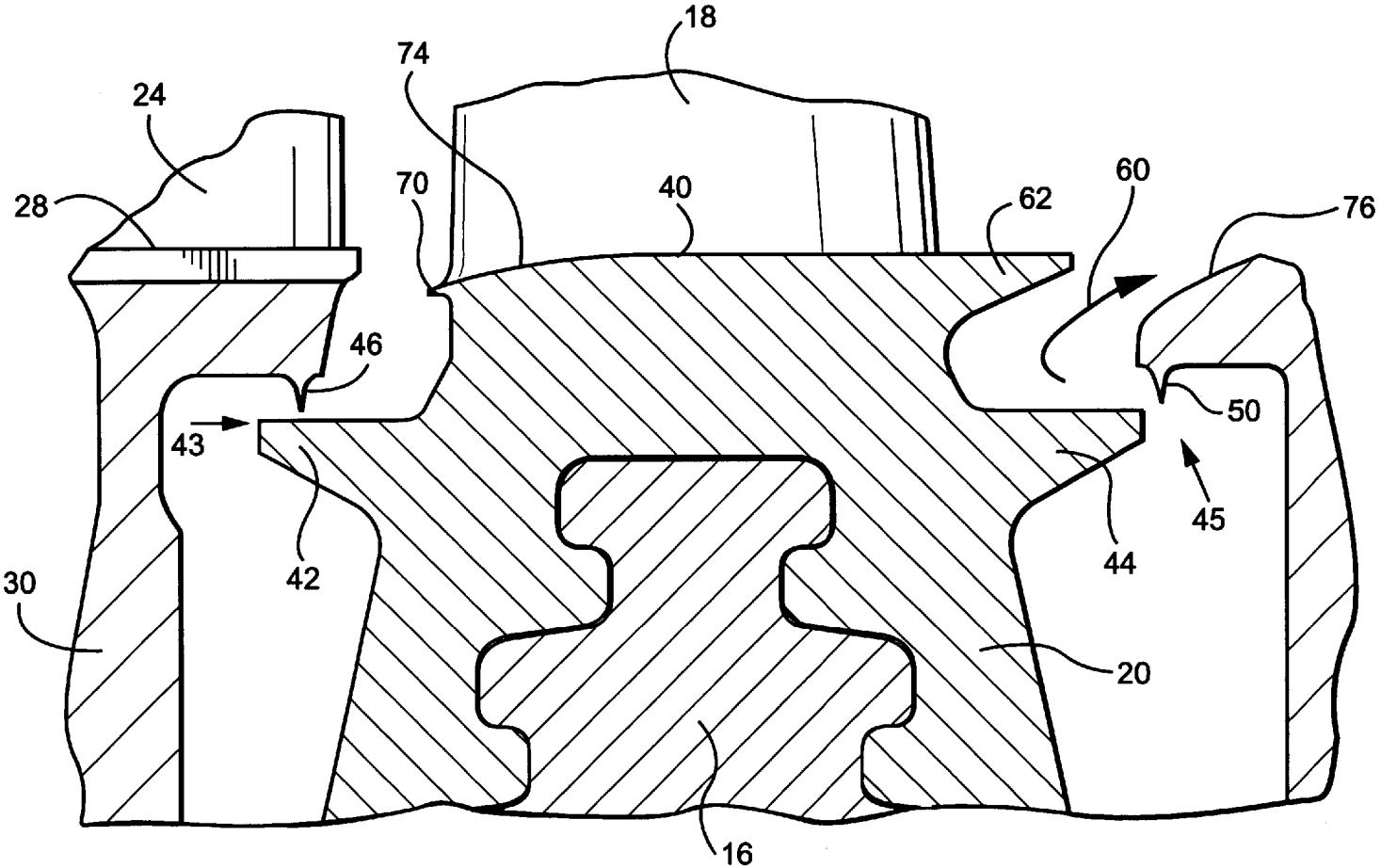
FIG. 2 is an enlarged fragmentary cross-sectional view thereof.

To minimize leakage flow and secondary aerodynamic losses and to ensure substantial streamlines in the fluid flow along the flowpath without upset from leakage flows, a root seal configuration is provided in accordance with a preferred embodiment of the present invention. The root seal configuration includes on each bucket dovetail 20 an entrance root radial seal projection 42 and an exit root radial seal projection 44. Each radial root seal thus includes an axially extending projection 42 or 44 which, together with a labyrinth tooth and the adjacent stationary component, reduces leakage flow about the buckets. Particularly, the entrance side root radial seal projection 42 cooperate with a labyrinth tooth 46 formed on the downstream side of the upstream nozzle 24 to seal off leakage flows into the wheel space 48 between the bucket dovetail 20 and the upstream inner web 30 and hence forms an entrance root radial seal, generally indicated 43 (FIG. 2). Similarly, a labyrinth tooth 50 on the upstream side of the downstream nozzle cooperates with the exit side root radial projection 44 to form an exit side root radial seal, generally indicated 45, for reducing leakage flow into the wheel space 52 between dovetails 20 and the downstream inner web 30. As illustrated in the drawing figures, the entrance and exit side root radial seals 43 and 45, respectively, lie radially inwardly of the root region of the flowpath 10. It will be appreciated that the labyrinth teeth 46 and 50 and the entrance and exit seals 43 and 45 are annular in configuration. Also, as illustrated, the wheel spaces 48 and 52 are minimized in an axial direction to reduce rotor pumping action. Rotor pumping action in an axial direction tends to produce radial flow which intrudes upon the fluid flow along the flowpath and causes adverse aerodynamic losses.

As illustrated in FIG. 1, the leakage flowpaths include leakage flow between the upstream packing ring 34 and the rotor 14, as indicated by the arrow 54. The leakage flow 54 combines with leakage flow between the upstream nozzle and downstream buckets indicated by the arrow 56 for passage through a wheel hole 58 into the wheel space 52 between the wheel 16 and the inner web 30. The pumping action causes a portion of the leakage flow to flow radially outwardly as indicated by the arrow 60 into the fluid of the flowpath 10. This radial outward flow causes a flowpath disturbance or upset of the fluid flow in the flowpath with consequent aerodynamic losses. To minimize those losses, there is provided on the trailing edge of each bucket an exit flow guide 62. The flow guide 62 includes a radial inner surface 64 shaped and configured to cause the radial outward leakage flow to enter the fluid in the flowpath 10 in a predominantly axial direction, i.e., decreases the radial component of the flow intruding upon the flowpath 10. Thus, the flowpath disturbance by the radial outward leakage flow is minimized. This is significant also because the capacity of packing ring seal 34 decreases over time with contact between the labyrinth teeth 38 and the rotor surface 36, causing greater leakage flows and hence greater intrusion flows. It will also be appreciated that the flow guides 62 of dovetails 20 form an annulus about the rotor axis and minimize the distance between the trailing edges of the buckets 18 and the next stage nozzle leading edge. The latter improves the fluid flow streamline characteristics in flowpath 10.

As best illustrated in FIG. 2, on the entrance side of the bucket, there is an axially upstream projecting leading edge or fin 70 which is flared radially inwardly in an upstream direction to lie radially inwardly of the downstream edge of the inner band 28 of the upstream nozzle 24. The bucket entrance side root axial sealing fin 70 affords additional reduction in flow coefficient which further reduces leakage flow. The fin 70 also reduces the axial distance between the nozzle and bucket and affords improved fluid flow streamline characteristics in flowpath 10. The entrance side radius fin 74 minimizes the possibility of a forwardly-facing protuberance in the fluid flow along flowpath 10 in the steady state operating condition. Thus, it will be appreciated that the bucket entrance root diameter is less than the nozzle exit root diameter.

Similarly, and referring to FIG. 2, the nozzle entrance root radius or leading edge 76 forms an axially upstream and radially inwardly tapering surface which terminates radially inwardly of the trailing edge of the platform 40 of the upstream buckets. Thus, fluid streamlines are maintained in the fluid flow along flowpath 10 as the fluid flow transitions from the trailing edge of the buckets to the leading edge of the downstream inner nozzle bands.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a rotor having wheels at axially spaced locations along the rotor and mounting a plurality of circumferentially spaced buckets, said rotor being rotatable about an axis;

axially spaced circumferential arrays of nozzles having circumferentially spaced airfoils and inner and outer bands at opposite ends thereof, said axially spaced buckets and said arrays of nozzles forming at least a pair of axially spaced stages of the turbine;

said buckets having dovetails for securing the buckets to the rotor wheels and platforms along radially inner ends of the buckets, said platforms, said airfoils, said inner and outer bands and said buckets in part defining a flowpath for fluid flow through the turbine;

said bucket dovetails on said wheels mounting projections extending generally axially toward one of said arrays of nozzles along locations radially inwardly of said platforms, said nozzles of said one array thereof carrying labyrinth teeth forming with said projections a seal to reduce leakage flowing from said flowpath into a wheel space between said one wheel and said one array of nozzles; and leading edges of the bucket platforms lying radially inwardly of trailing edges of the inner bands of next-adjacent upstream nozzles.

2. A turbine according to claim 1 wherein said buckets include bucket entrance side root sealing fins projecting axially upstream toward next-adjacent upstream nozzles affording streamline characteristics to the fluid in the flowpath.

3. A turbine comprising:

a rotor having wheels at axially spaced locations along the rotor and mounting a plurality of circumferentially spaced buckets, said rotor being rotatable about an axis;

axially spaced circumferential arrays of nozzles having circumferentially spaced airfoils and inner and outer bands at opposite ends thereof, said axially spaced buckets and said arrays of nozzles forming at least a pair of axially spaced stages of the turbine;

said buckets having dovetails for securing the buckets to the rotor wheels and platforms along radially inner ends of the buckets, said platforms, said airfoils, said inner and outer bands and said buckets in part defining a flowpath for fluid flow through the turbine;

said bucket dovetails on said wheels mounting projections extending generally axially toward one of said arrays of nozzles along locations radially inwardly of said platforms, said nozzles of said one array thereof carrying labyrinth teeth forming with said projections a seal to reduce leakage flowing from said flowpath into a wheel space between said one wheel and said one array of nozzles; and said buckets having bucket entrance root diameters less than nozzle exit root diameters of next-adjacent upstream nozzles.

4. A flowpath streamlining configuration for root regions of a turbine flowpath comprising:

a rotor rotatable about an axis and mounting a plurality of circumferentially spaced buckets;

an axially spaced circumferential array of nozzles having circumferentially spaced airfoils with inner and outer bands at opposite ends thereof spaced axially downstream of said buckets;

said buckets having dovetails for securing the buckets and rotor to one another and platforms along radially inner ends thereof, said platforms and said inner bands in part defining the root region of the flowpath for fluid flow through the turbine;

said bucket dovetails including exit flow guides along a downstream side of the dovetails for directing leakage fluid flow from a wheel space between said dovetails and said nozzles into the flowpath in a predominantly downstream axial direction;

said flow guides forming downstream extensions of the bucket platforms to minimize the gap between the buckets and the array of nozzles;

leading edges of the downstream nozzles lying radially inwardly of said downstream extensions of the bucket platforms.

5. A flowpath streamlining configuration for root regions of a turbine flowpath comprising:

a rotor rotatable about an axis and mounting a plurality of circumferentially spaced buckets;

an axially spaced circumferential array of nozzles having circumferentially spaced airfoils with inner and outer bands at opposite ends thereof spaced axially downstream of said buckets;

said buckets having dovetails for securing the buckets and rotor to one another and platforms along radially inner ends thereof, said platforms and said inner bands in part defining the root region of the flowpath for fluid flow through the turbine;

said bucket dovetails including exit flow guides along a downstream side of the dovetails for directing leakage fluid flow from a wheel space between said dovetails and said nozzles into the flowpath in a predominantly downstream axial direction; and a second circumferential array of nozzles upstream of said buckets having circumferentially spaced airfoils with inner and outer bands at opposite ends thereof, leading edges of the bucket platforms lying radially inwardly of trailing edges of the inner bands of the upstream array of nozzles.

6. A flowpath streamlining configuration for root regions of a turbine flowpath comprising:

a rotor rotatable about an axis and mounting a plurality of circumferentially spaced buckets;

an axially spaced circumferential array of nozzles having circumferentially spaced airfoils with inner and outer bands at opposite ends thereof spaced axially downstream of said buckets;

said buckets having dovetails for securing the buckets and rotor to one another and platforms along radially inner ends thereof, said platforms and said inner bands in part defining the root region of the flowpath for fluid flow through the turbine;

said bucket dovetails including exit flow guides along a downstream side of the dovetails for directing leakage fluid flow from a wheel space between said dovetails and said nozzles into the flowpath in a predominantly downstream axial direction; and a second circumferential array of nozzles upstream of said buckets and having circumferentially spaced airfoils with inner and outer bands at opposite ends thereof, said buckets having bucket entrance root diameters less than nozzle exit root diameters of the upstream array of nozzles.

7. A flowpath streamlining configuration for root regions of a turbine flowpath comprising:

a rotor rotatable about an axis and mounting a plurality of circumferentially spaced buckets;

an axially spaced circumferential array of nozzles having circumferentially spaced airfoils with inner and outer bands at opposite ends thereof spaced axially downstream of said buckets;

said buckets having dovetails for securing the buckets and rotor to one another and platforms along radially inner ends thereof, said platforms and said inner bands in part defining the root region of the flowpath for fluid flow through the turbine;

said bucket dovetails including exit flow guides along a downstream side of the dovetails for directing leakage fluid flow from a wheel space between said dovetails and said nozzles into the flowpath in a predominantly downstream axial direction; and a second circumferential array of nozzles upstream of said buckets and having circumferentially spaced airfoils with inner and outer bands at opposite ends thereof, said buckets including bucket entrance side root axial upstream sealing fins projecting toward the upstream array of nozzles affording streamline characteristics to the fluid in the flowpath.

8. A turbine comprising:

a rotor having wheels at axially spaced locations along the rotor and mounting a plurality of circumferentially spaced buckets, said rotor being rotatable about an axis;

axially spaced circumferential arrays of nozzles having circumferentially spaced airfoils and inner and outer bands at opposite ends thereof, said axially spaced buckets and said arrays of nozzles forming at least a pair of axially spaced stages of the turbine;

said buckets having dovetails for securing the buckets to the rotor wheels and platforms along radially inner ends of the buckets, said platforms, said airfoils, said inner and outer bands and said buckets in part defining a flowpath for fluid flow through the turbine;

said bucket dovetails on said wheels mounting projections extending generally axially toward one of said arrays of nozzles along locations radially inwardly of said platforms, said nozzles of said one array thereof carrying labyrinth teeth forming with said projections a seal to reduce leakage flowing from said flowpath into a wheel space between said one wheel and said one array of nozzles, said bucket dovetails including exit flow guides along a downstream side thereof having surfaces for directing fluid flow into the flowpath in a predominantly axial downstream direction, said flow guides forming downstream extensions of the bucket platforms to minimize the gap between the buckets and a next-adjacent array of nozzles forming part of a downstream turbine stage; and leading edges of the next-adjacent downstream nozzles lying radially inwardly of said downstream extensions of the bucket platforms.

* * * * *